United States Patent [19]

Cartwright

[11] Patent Number: 4,939,917

[45] Date of Patent: Jul. 10, 1990

[54] KEY CONTROL OF IMPORTANT SECURITY KEYS

[76] Inventor: Edward V. Cartwright, c/o Philadelphia Electric Co., 2301 Market St., P.O. Box 8699, Philadelphia, Pa. 19101

[21] Appl. No.: 450,543

[22] Filed: Dec. 14, 1989

[51] Int. Cl.[5] ..... A47G 29/10

[52] U.S. Cl. ..... 70/456 R; 70/459

[58] Field of Search ..... 70/456 R, 456 B, 457, 70/458, 459; 150/40; 24/3 K; 292/317, 307

[56] References Cited

U.S. PATENT DOCUMENTS

| | | | |
|---|---|---|---|
| 1,667,258 | 4/1928 | Holla | 70/456 R |
| 2,420,125 | 5/1947 | Crist . | |
| 2,442,479 | 6/1948 | Adair | 70/456 R |
| 2,672,043 | 3/1954 | Folscheid . | |
| 2,813,620 | 11/1957 | Hansen . | |
| 3,127,918 | 4/1964 | McElvain . | |
| 3,406,546 | 10/1968 | Clement . | |
| 3,420,078 | 1/1969 | Nielsen . | |
| 3,606,777 | 9/1971 | Watson . | |
| 3,779,589 | 12/1973 | Patterson | 292/317 |
| 4,037,716 | 7/1977 | Marks . | |
| 4,048,824 | 9/1977 | Blackmon . | |
| 4,072,033 | 2/1978 | Eckerdt . | |
| 4,364,250 | 12/1982 | Toyoda . | |
| 4,422,316 | 12/1983 | Thomas et al. . | |
| 4,445,622 | 5/1984 | Sideri . | |
| 4,474,043 | 10/1984 | Morrone | 70/456 R |
| 4,493,433 | 1/1985 | Sideri et al. . | |
| 4,571,967 | 2/1986 | Jacobsen | 70/456 R |

*Primary Examiner*—Robert L. Wolfe

*Attorney, Agent, or Firm*—Paul & Paul

[57] ABSTRACT

A secure holder for a key which provides for limited access to that key. A first and second plate retain a key securely therein and a wire and seal is used to inhibit access and determine if the key has been accessed. Also, a key ring holds the key to the first plate and a single pin holds the first and second plate together, in a pivotal relationship.

10 Claims, 1 Drawing Sheet

KEY CONTROL OF IMPORTANT SECURITY KEYS

FIELD OF THE INVENTION

The present invention generally relates to a key holder for containing high security keys, and, more particularly to a tamperproof key holder which alerts an interested party, upon visual inspection, whether a key contained therein has been used.

BACKGROUND OF THE INVENTION

It is often desirable to limit access into areas considered to be high security. For example, one may wish to allow only certain authorized individuals to have access into rooms where confidential documents or expensive articles of equipment are kept. Insofar as areas of this type are usually accessed by keys, it is desirable that those keys be retained in a secure environment. Therefore, in order to accomplish the objective of limiting access to secure areas, a key retainer or holder is desirable.

A number of key enclosures, or the like, which secure keys retained therein are known. U.S. Pat. No. 2,420,125 discloses an enclosure having a box-like construction where access to the key is obtained by breaking the front transparent member of the enclosure. The transparent front member is then replaced for reuse.

Similarly, various non-transparent key enclosures employ locking devices which provide access into the enclosure. For example, in U.S. Pat. Nos. 2,813,620 and 2,672,043 there is disclosed the use of a master key and combination lock, respectively, to gain access into the key containers.

U.S. Pat. Nos. 4,493,433 and 4,445,622 disclose similar apparently non-transparent containers which permanently enclose a key. Access to the key is obtained by destroying the enclosure.

One problem associated with the use of some of these containers is that gaining access to keys contained therein requires either complete or substantial destruction of the container itself. Others require the use of a lock on the container which is incapable of signalling to an observer any use of the key retained therein, whether such use is authorized or nonauthorized. Furthermore, these key containers, due to their boxlike construction comprise a number of components and therefore are expensive to manufacture.

Two other patents, U.S. Pat. Nos. 4,037,716 and 3,127,918 disclose transparent panel type enclosures, wherein a key is contained in a recess in one panel and another panel is overlaid to enclose the key in the container. These are reusable devices. However, their lack of a security feature for preventing any unauthorized uses of a key retained therein frustrate the primary purpose of the present invention; namely security.

Therefore an object of the present invention is to provide a secure environment for retention of a key.

A further object is to provide a secure key holder capable of being quickly inspected for any unauthorized use.

A further object is to provide a secure key holder that is reusable and inexpensive to manufacture.

SUMMARY OF THE INVENTION

The present invention is directed to a key holder providing a secure, tamperproof environment for a key contained therein and which is capable of readily disclosing any unauthorized use of said key through visual inspection.

The key holder of the invention is comprised of a first plate having a routed region located therein and a second plate superimposed over said first plate. The key holder further includes means facilitating access to a key contained within said holder and tamperproofing means for detecting, upon visual inspection, any unauthorized use of said key.

BRIEF DESCRIPTION OF THE DRAWINGS

The foregoing summary, as well as the following detailed description will be better understood when read in conjunction with the appended drawings. For the purpose of illustrating the invention, there is shown in the drawings an embodiment which is presently preferred, it being understood, however, that this invention is not limited to the precise arrangement and instrumentalities shown.

DETAILED DESCRIPTION OF THE PREFERRED EMBODIMENT

Figure 1:
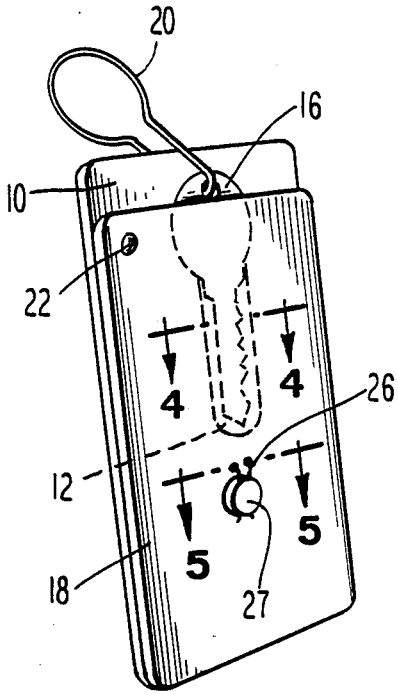
FIG. 1 is a perspective view of the preferred embodiment closed and with seal attached.

Referring to the drawings in detail where like numerals indicate like elements throughout, there is shown in FIG. 1 a perspective view of the preferred embodiment of the invention.

A first plate 10 acts as a support. A routed region 12 is located therein for receiving a key 16. A second plate 18 is superimposed over the first plate 10 to act as a cover. Each plate is preferably made of plastic and is at least semi-opaque. This opacity of the plates prevents the grooves and serrations of the key from being visible and thus enhances the security of the key by preventing copying of those serrations and grooves.

A key ring 20 is integrally connected to both the first plate 10 and key 16, to the exclusion of the second plate 18, for facilitating easier storage and mobility of the key 16. In the present embodiment, the first plate 10 is slightly longitudinally longer than the second plate so as to allow exclusion of connection of the ring 20 to the second plate 18. The ring 20 is made of metal in the preferred embodiment.

Figure 2:
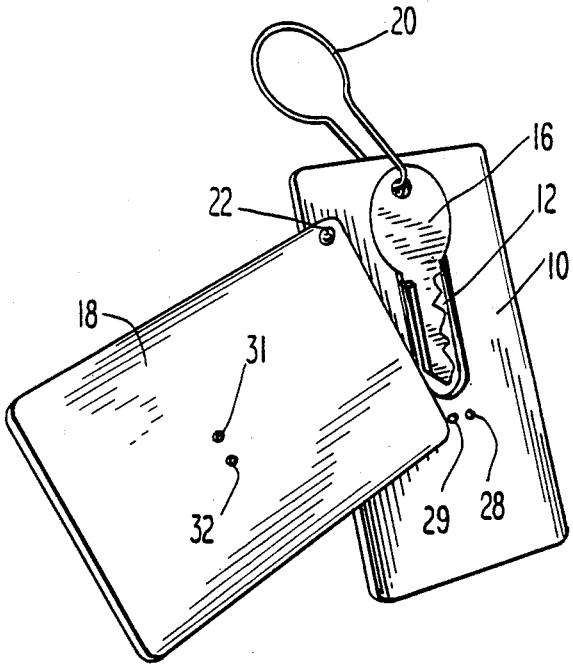
FIG. 2 is a perspective view of the preferred embodiment open.

A pin 22 also made of metal, is utilized in the embodiment as means connecting plates 10 and 18. The pin 22 permits rotation of either the plate 10 or the plate 18 or both around itself, as seen at FIG. 2, wherein plate 18 has been rotated aside for access to the key. Returning now to FIG. 1, a metal wire 26 is seen. Holes 28 and 29 on the first plate 10 and the holes 31 and 32 on the second plate 18 meet in mating alignment and permit the wire 26 to pass through the plates. The ends of wire are then sealed by lead seal 27 and access to the key 16 is effectively blocked. Prior to using the key, one must cut the wire 26. Hence, a person can easily detect whether the key 16 has been used by seeing whether the wire 26 has been snipped.

Figure 3:
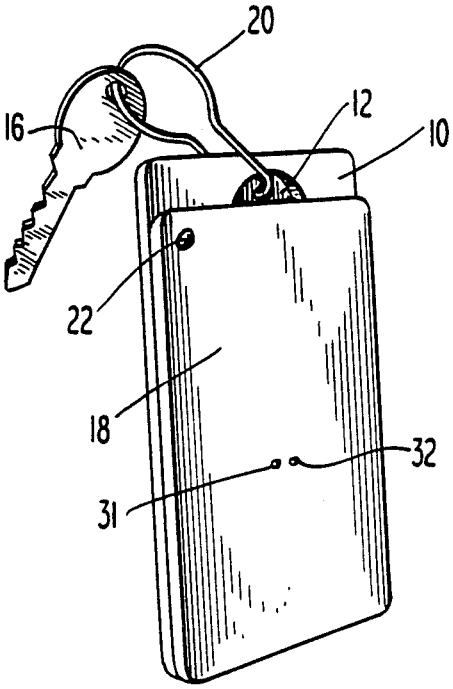
FIG. 3 is a perspective view of the preferred embodiment after it is opened and the key is removed.
Figure 4:
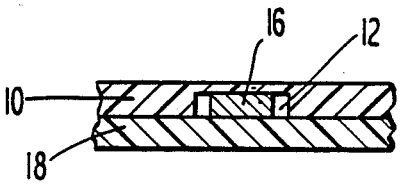
FIG. 4 is a sectional view through FIG. 1.
Figure 5:
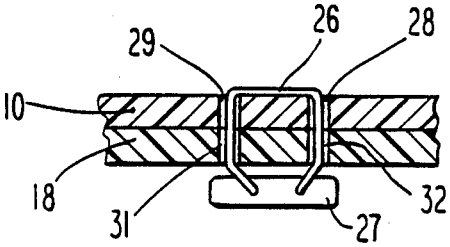
FIG. 5 is a sectional view through FIG. 1.

At FIG. 3 is seen the embodiment closed but with the key outside the holder. The empty cavity is visible although the holder is closed, unlike, for example, FIG. 1 where the top of the key 16 is visible.

It will be recognized by those skilled in the art that changes may be made to the above-described embodiment of the invention without departing from the broad inventive concepts thereof. It is understood, therefore, that this invention is not limited to the particular embodiment disclosed, but it is intended to cover all modifications which are within the scope and spirit of the invention as defined by the appended claims.

I claim:

1. A tamperproof key holder for preventing the unauthorized use of a key contained therein comprising:

a first plate acting as a support for said holder having a routed region located therein for receiving a key;

a second plate superimposed over said first plate acting as a cover for said holder; connecting means between said first and second plates so that access to said key is facilitated, and, tamperproofing means for determining, upon visual inspection, whether a key contained in said holder has been used.

2. A key holder as in claim 1 wherein said connecting means facilitating access comprises a pin pivotally connecting said first plate and said second plate.

3. A key holder as in claim 1 wherein said tamperproofing means comprises a wire means and a seal means, with mating pass through means for said wire means in said first and second plates.

4. A key holder as in claim 1 further including a key ring connected to both said first plate and said key, for retaining said key while enclosed within said holder.

5. A key holder as in claim 1 wherein said first plate is slightly longer than said second plate.

6. A key holder as in claim 1 wherein said first and second plates are made of a semi-opaque plastic.

7. A tamperproof key holder comprising a first plate acting as a support for said holder having a routed region located therein for receiving a key, a second plate superimposed over said first plate acting as a cover for said holder, a pin pivotally connecting said first plate and said second plate, and a contiguous wire means, having a first and second ends and passing through mating pass through means on both said first and second plate with said first and second ends meeting in front of said second plate and a seal means sealing said first and second ends of said wire means.

8. A key holder as in claim 7 further including a key ring connected to both said first plate and said key, for retaining said key while enclosed within said holder.

9. A key holder as in claim 8 wherein said first plate is slightly longer than said second plate.

10. A key holder as claim 7 wherein said first and second plates are made of a semi-opaque plastic.

* * * * *